US007871244B2

(12) United States Patent
Marini et al.

(10) Patent No.: US 7,871,244 B2
(45) Date of Patent: Jan. 18, 2011

(54) RING SEAL FOR A TURBINE ENGINE

(75) Inventors: Bonnie D. Marini, Oviedo, FL (US); Douglas A. Keller, Kalamazoo, MI (US)

(73) Assignee: Siemens Energy, Inc., Orlando, FL (US)

( * ) Notice: Subject to any disclaimer, the term of this patent is extended or adjusted under 35 U.S.C. 154(b) by 1197 days.

(21) Appl. No.: 11/707,193

(22) Filed: Feb. 15, 2007

(65) Prior Publication Data

US 2008/0273967 A1 Nov. 6, 2008

(51) Int. Cl.
*F01D 11/12* (2006.01)

(52) U.S. Cl. ..... 415/173.4; 415/173.5; 415/173.6; 415/174.4; 415/174.5; 416/228; 416/241 R

(58) Field of Classification Search ..... 415/173.4, 415/173.5, 173.6, 174.4, 174.5; 416/228, 416/241 R See application file for complete search history.

(56) References Cited

U.S. PATENT DOCUMENTS 4,239,452 A * 12/1980 Roberts, Jr. ..... 415/173.5
4,466,772 A * 8/1984 Okapuu et al. ..... 415/173.5
4,573,866 A 3/1986 Sandy, Jr. et al.
4,650,394 A 3/1987 Weidner
4,650,395 A 3/1987 Weidner
4,714,406 A * 12/1987 Hough ..... 415/173.5
4,764,089 A 8/1988 Strangman
4,930,729 A * 6/1990 Savill ..... 244/200
5,439,348 A 8/1995 Hughes et al.
5,846,055 A * 12/1998 Brodersen et al. ..... 415/206
5,899,660 A 5/1999 Dodd
5,951,892 A * 9/1999 Wolfla et al. ..... 277/415
6,409,471 B1 6/2002 Stow
6,589,600 B1 * 7/2003 Hasz et al. ..... 427/264
6,644,914 B2 11/2003 Lawer et al.
6,663,739 B2 12/2003 Walker et al.
6,670,046 B1 * 12/2003 Xia ..... 428/469
6,702,553 B1 3/2004 Gorman
6,811,373 B2 11/2004 Tomita et al.
6,830,428 B2 * 12/2004 Le Biez et al. ..... 415/173.4
6,969,231 B2 11/2005 Ghasripoor et al.
7,001,145 B2 2/2006 Couture et al.
7,302,990 B2 * 12/2007 Bunker et al. ..... 164/28

FOREIGN PATENT DOCUMENTS

EP 1 113 146 A2 7/2001
WO WO 2005/071228 A1 8/2005

* cited by examiner

*Primary Examiner*—Igor Kershteyn

(57) ABSTRACT

A turbine engine ring seal for sealing gaps between turbine engine outer seal segments and turbine blade tips. The turbine engine ring segment may have an inner radial surface that defines a portion of a gap gas flow path where the inner radial surface may be formed of an abradable ceramic coating and includes a plurality of gas flow protrusions that are oriented transverse to the gap gas flow path. The gas flow protrusions may induce vortices in the gas flow in the gap gas flow path. Additionally, the gas flow protrusions may be series of peaks and depressions between two adjacent peaks, where the depressions have an approximate semicircular shape. The distance between two adjacent peaks may be equal or greater than a width of the depression and the height of a single peak may be six percent or greater than the distance between two adjacent peaks.

15 Claims, 4 Drawing Sheets

RING SEAL FOR A TURBINE ENGINE

FIELD OF THE INVENTION

This invention is directed generally to turbine engine ring seals and turbine engine ring segments thereof, and more particularly to the inner radial surface of turbine engine ring segments.

BACKGROUND

Turbine engines commonly operate at efficiencies less than the theoretical maximum because, among other things, losses occur in the flow path as hot compressed gas travels down the length of the turbine engine. One example of a flow path loss is the leakage of hot combustion gases across the tips of the turbine blades where work is not exerted on the turbine blade. This leakage occurs across a space between the tips of the rotating turbine blades and the surrounding stationary structure, such as ring segments that form a ring seal. This spacing is often referred to as the blade tip clearance.

Blade tip clearances cannot be eliminated because, during transient conditions such as during engine startup or part load operation, the rotating parts (blades, rotor, and discs) and stationary parts (outer casing, blade rings, and ring segments) thermally expand at different rates. As a result, blade tip clearances can actually decrease during engine startup until steady state operation is achieved at which point the clearances can increase, thereby reducing the efficiency of the engine.

Although control systems have been developed to address the differences in blade tip clearance throughout the operational state of the turbine engine, inefficiencies still exist. Other structural improvement to blade tips and/or blade ring seals have not eliminated the inefficiencies. Thus, there is a need for reducing leakage past turbine blade tips in order to maximize the efficiency of a turbine engine.

SUMMARY OF THE INVENTION

This invention relates to a turbine engine ring seal segment and ring seal for increasing the efficiency of the turbine engine by obstructing gas flow between a turbine engine ring seal segment and radially inward turbine blade tips. In particular, the turbine ring segment may include a turbine engine ring segment with an inner radial surface having a plurality of protrusions that induce vortices in gas flow along the length of the inner radial surface. The vortices create gas barriers that obstruct further gas flow between the blade tip and the turbine engine ring seal segment.

The turbine engine ring seal segment may include a turbine engine ring segment having an axial length and an inner radial surface. The inner radial surface may include a plurality of gas flow protrusions oriented transverse to the axial length. With this arrangement of gas flow protrusions, vortices may be induced in gas flow along the radial inner surface. Additionally, the inner radial surface may define a portion of a gap gas flow path that is between the inner radial surface and a turbine blade tip. In operation, the gas flow protrusions obstruct gas flow along the gap gas flow path.

In one embodiment, the plurality of gas flow protrusions may be a series of peaks and depressions. The depressions can have an approximate semicircular shape and the distance between two adjacent peaks can be equal or greater than the width of the depression. Also, the height of a single peak can be six percent or greater than the distance between two adjacent peaks. For example, the distance between two adjacent peaks can be equal or greater than the width of the depression while the height of a single peak can be equal or greater than one half of the width of the depression. Accordingly, the height of the peaks or the depth of the depressions, measured from the tip of the peaks to the shallowest point of the depressions, can range between about 0.12 mm and about 8 mm. The distance between two adjacent peaks can range between approximately 2 mm and 5 mm.

In another embodiment, the series of peaks and depressions may include two or more discontinuous series of peaks and depressions. Still further, a coating may be applied to the ring segment. The coating may form the inner radial surface and may include the gas flow protrusions. The coating may be an abradable material, such as friable graded insulation.

In another embodiment, a turbine engine ring seal segment may have an inner radial surface that defines a portion of a gap gas flow path. The inner radial surface may include a plurality of gas flow protrusions that are oriented transverse to the gap gas flow path, and the plurality of gas flow protrusions may be a series of peaks and depressions that obstruct gas flow along the gap gas flow path. In this arrangement, vortices may be induced in a gas flow in the gap gas flow path.

In yet another embodiment, a turbine engine is provided with one or more combustors positioned upstream from a rotor having a plurality of blades extending radially from the rotor. The turbine engine may include a vane carrier having a plurality of vanes extending radially inward and terminating proximate to the rotor. In this turbine engine, a turbine engine ring segment can be coupled to an inner peripheral surface of the vane carrier. The turbine engine ring segment may include an axial length and an inner radial surface. The inner radial surface may include a plurality of gas flow protrusions that are oriented transverse to the axial length and that induce vortices in a gas flow along the radial inner surface.

An advantage of this invention is that the efficiency of the turbine engine is increased.

Another advantage of this invention is that a coating can be used to form the plurality of protrusions.

Yet another advantage of this invention is that the coating can be abradable, and more particularly, the protrusions formed by the coating can be abradable.

Yet another advantage of this invention is that the depressions can have an approximate semicircular shape and the distance between two adjacent peaks can be equal or greater than the width of the depression while the height of single peak can be equal or greater than one half of the width of the depression.

Another advantage of this invention is that less of the gas flows through the tip gap and bypasses the blade, resulting in a decrease of tip losses and an increase in the efficiency of the overall turbine engine.

The presence of protrusions on the surface of the seal segment induces vorticity through at least two mechanisms. The first is to increase the form drag through the addition of roughness. The second enhancement is due to the presence of the protrusions changing the local velocity profile and hence the shear stress on the wall. This effect is related to the boundary layer thickness and the height and geometry of the protrusion or series of protrusions. The presence of a series of protrusions can result in small recirculation zones which act to choke the effective area and reduce freestream flow through the gap.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

As shown in FIGS. 1-4C, this invention is directed to a ring seal 34 for a turbine engine. Aspects of the invention will be explained in connection with a ring seal 34, but the invention may be used in other seals. This invention relates to a turbine engine ring seal 34 for increasing the efficiency of the turbine engine by obstructing gas flow between a turbine engine ring seal segment 50 and radially inward turbine blade tips 26. In particular, the turbine ring segment 50 may include a turbine engine ring segment 50 with an inner radial surface having a plurality of protrusions that induce vortices in gas flow along the length of the inner radial surface. The vortices create gas barriers that obstruct further gas flow between the blade tip 26 and the turbine engine ring seal segment 50.

Figure 1:
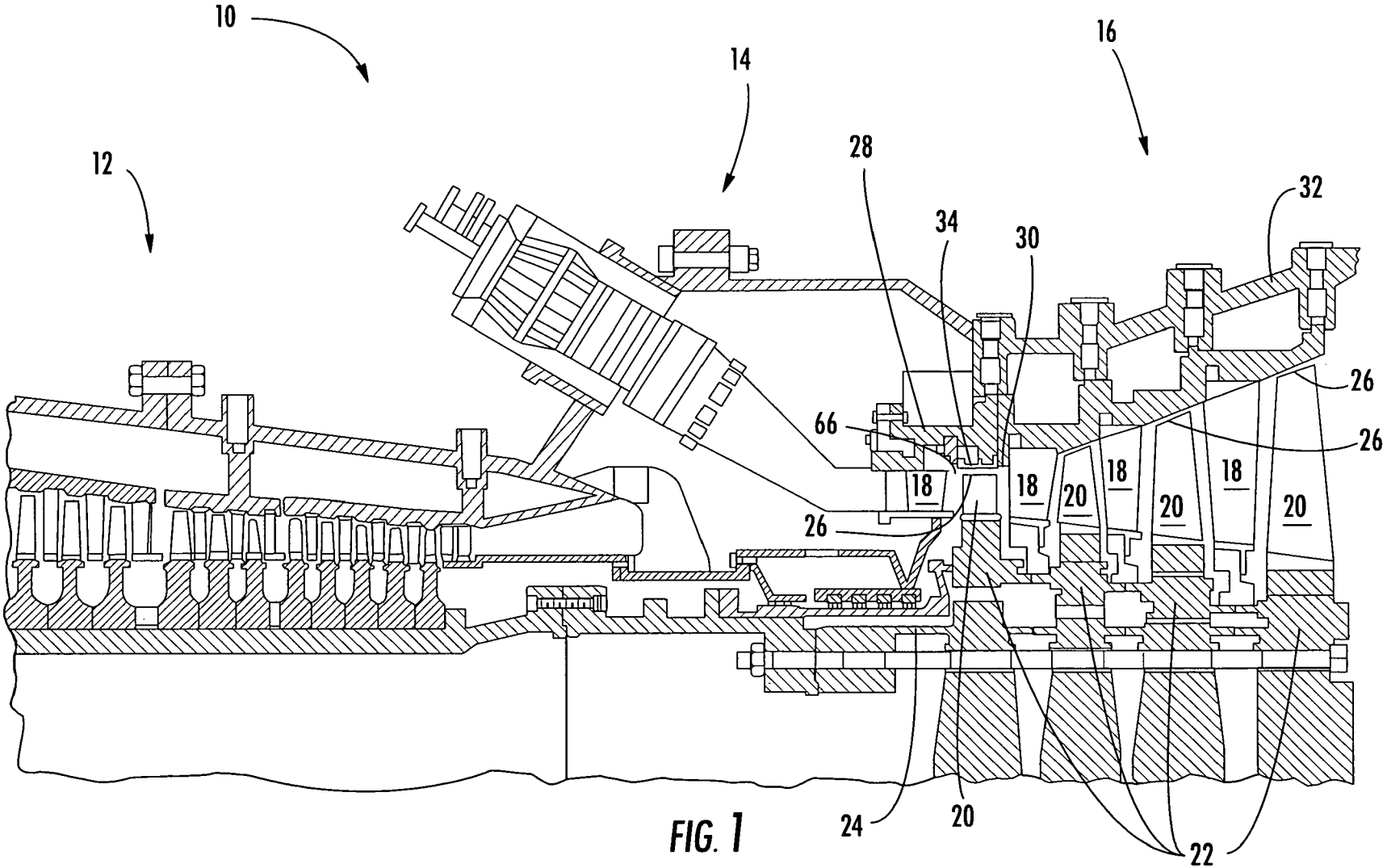
FIG. 1 is a cross-sectional view of a turbine section of a turbine engine with a ring seal segment according to aspects of the invention.

FIG. 1 shows an example of a turbine engine 10 having a compressor 12, a combustor 14 and a turbine 16. In the turbine section 16 of a turbine engine, there are alternating rows of stationary airfoils 18, commonly referred to as vanes, and rotating airfoils 20, commonly referred to as blades. Each row of blades 20 is formed by a plurality of airfoils 20 attached to a disc 22 provided on a rotor 24. The blades 20 can extend radially outward from the discs 22 and terminate in a region known as the blade tip 26. Each row of vanes 18 is formed by attaching a plurality of vanes 18 to a turbine engine support structure, such as vane carrier 28. The vanes 18 can extend radially inward from an inner peripheral surface 30 of the vane carrier 28 and terminate proximate to the rotor 24. The vane carrier 28 may be attached to an outer casing 32, which may enclose the turbine section 16 of the engine 10.

A ring seal 34 may be connected to the inner peripheral surface 30 of the vane carrier 28 between the rows of vanes 18. The ring seal 34 is a stationary component that acts as a hot gas path guide positioned radially outward from the rotating blades 20. The ring seal 34 may formed by a plurality of metal ring segments or ring segments formed of ceramic matrix composite (CMC), as discussed further herein. The ring segments 50 can be attached either directly to the vane carrier 28 or indirectly such as by attaching to metal isolation rings (not shown) that attach to the vane carrier 28. Each ring seal 34 can substantially surround a row of blades 20 such that the tips 26 of the rotating blades 20 are in close proximity to the ring seal 34.

Figure 2:
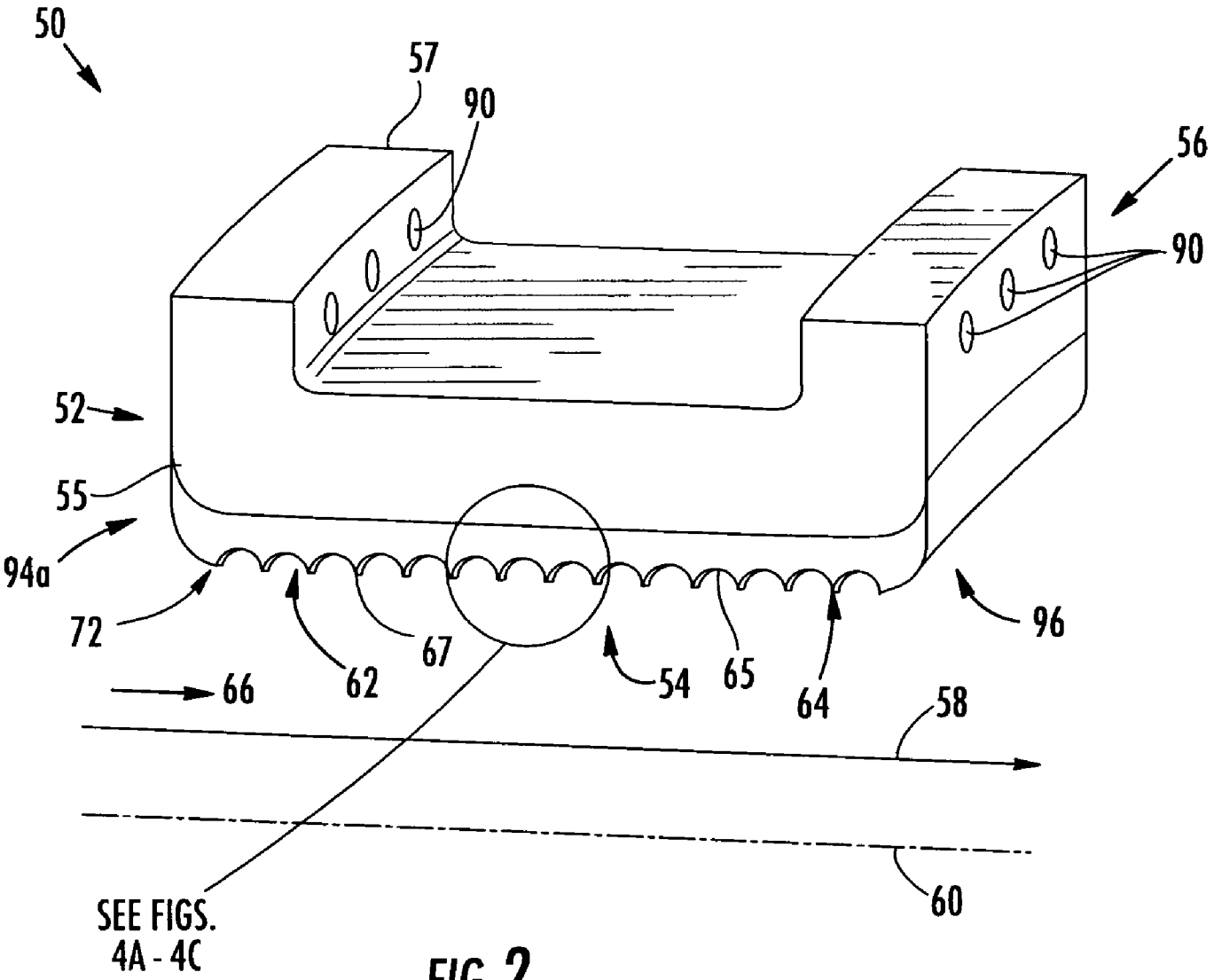
FIG. 2 is an perspective view of a ring seal segment according to aspects of the invention.

FIG. 2 shows a turbine engine ring segment 50 according to aspects of the invention. The ring segment 50 can be, for example, a ring seal segment 50 that forms a portion of the ring seal 34 shown in FIG. 1. The ring seal segment 50 may have a forward span 52, an extension 54, an aft span 56 and an inner radial surface 62, relative to the axis of the turbine 60. The extension 54 and inner radial surface 62 may extend along the axial length of the ring seal segment 54. The extension 54 may transition into the forward span 52 in a first region 94, and; the extension 54 may transition into the aft span 56 in a second region 96 that is opposite to the first region 94. The terms "forward" and "aft" are intended to mean relative to the direction of the gas flow 58 through the turbine section when the ring seal segment 50 is installed in its operational position. One or more passages 90 can extend through each of the forward and aft spans 52, 56. Each passage 90 can receive a fastener (not shown) so as to connect the ring seal segment 50 to a turbine stationary support structure (not shown).

The ring seal segment 50 can also have a first circumferential end 55 and a second circumferential end 57. The term "circumferential" is intended to mean circumferential about the turbine axis 60 when the ring seal segment 50 is installed in its operational position. The ring seal segment 50 can be curved circumferentially as it extends from the first circumferential end 55 to the second circumferential end 57. In such case, a plurality of the ring seal segments 50 can be installed so that each of the circumferential ends 55, 57 of a ring seal segment 50 is adjacent to one of the circumferential ends of an adjacent ring seal segment 50 so as to collectively form an annular ring seal 34.

The inner radial surface 62 of the ring seal segment 50 can define a portion of a gap gas flow path 66 that is the area between the inner radial surface 62 and the blade tip 26 and is generally annular in shape following the circumference of the annular ring seal 34. The inner radial surface 62 can include a plurality of protrusions 64 that obstruct gas flow along the gap gas flow path 66 by inducing the formation of vortices in the gas flow along the radial inner surface 62. Each protrusion 64 can induce the formation of a vortex in the gas flow. The formation of vortices helps to obstruct further flow from passing by the blade tip 26 without exerting force on the blade 20.

The plurality of protrusions 64 can be oriented generally transverse to the direction of gas flow 58 to maximize the inducement of vortices and the obstruction of gas flow. The plurality of protrusions 64 can also be oriented perpendicularly transverse to the axial length of extension 54, such that the plurality of protrusions 64 is generally transverse to the axial direction of the axis of the turbine 60. Nevertheless, other orientations are possible.

The plurality of protrusions 64 can be a series of peaks 67 and depressions 65. The height of the protrusions 64, or the peaks 67 and depressions 65, and the distance between two adjacent peaks 67 or the centers of two adjacent depressions 65 can be varied in accordance with the speed of the gas flow.

In one embodiment, the depressions 65 can have a substantially semicircular shape, where the semicircular has a radius (r). The distance between two adjacent peaks 67 can be equal to, or greater than, the width of the depression 65, thus, the distance between two adjacent peaks 67 can be 2(r). Nevertheless, the peaks 67 may be positioned such that the distance between the centers of two adjacent peaks 67 may be greater than 2(r). Likewise, the depressions 65 may also have an appreciable width such that instead of having a substantially semicircular shape, the depressions 65 can have a substantially semi-oval shape.

The height of a single peak 67 may be six percent or greater than the distance between two adjacent peaks 67. For example, when the depression 65 has a substantially semicircular shape with a radius (r), the distance between two adjacent peaks 67 can be equal or greater than the width 2(r) of the depression 65 while the height of single peak 67 can be equal to, or greater than, one half of the width of the depression 65, or in this example, equal to (r), the radius of the depression 65. In any arrangement, the distance between two adjacent peaks 67 can range between approximately 2 mm and 5 mm. Additionally, the height of the peaks 67, measured from the tip of the peaks 67 to the shallowest point of the depressions 65, can range between 0.12 mm and 8 mm.

Figure 4A:
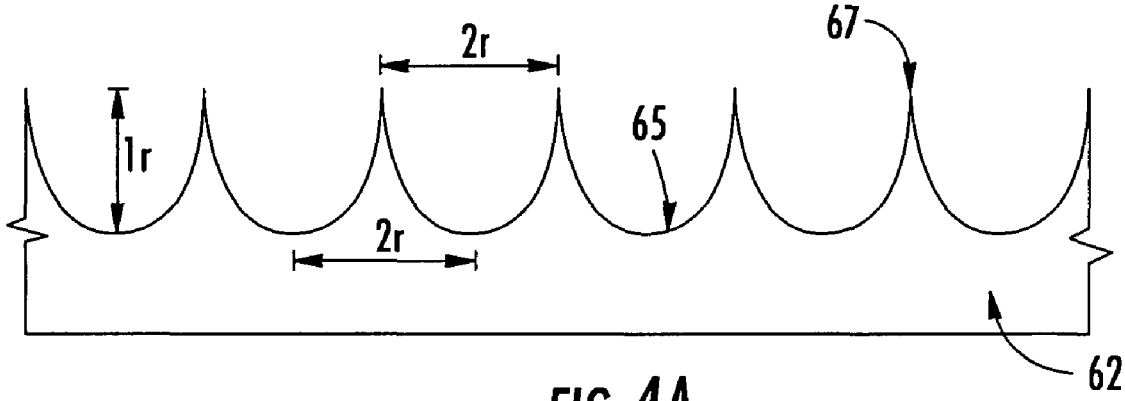
FIG. 4A is a detailed view of one embodiment of a portion of the ring seal segment of FIG. 2 according to aspects of the invention.
Figure 4B:
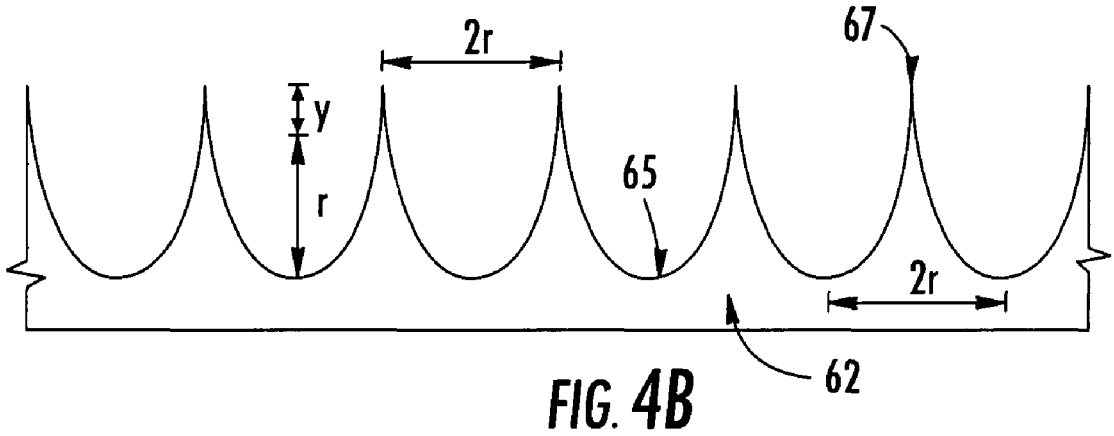
FIG. 4B is a detailed view of one embodiment of a portion of the ring seal segment of FIG. 2 according to aspects of the invention.
Figure 4C:
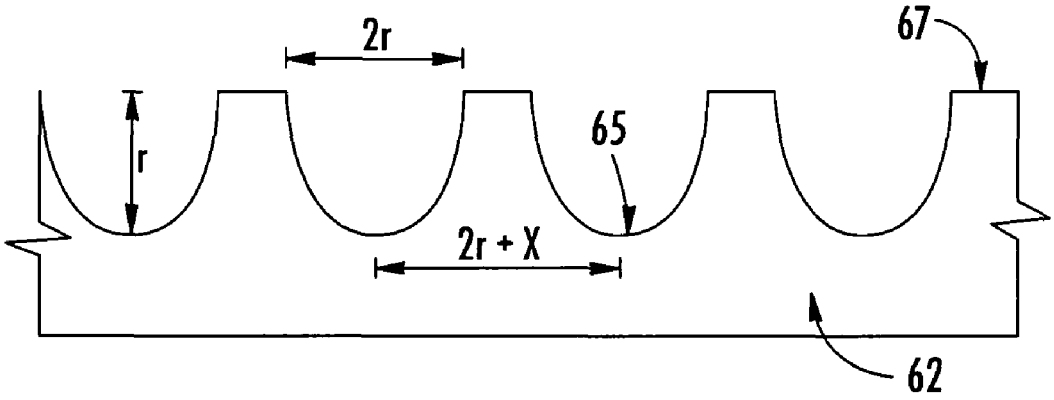
FIG. 4C is a detailed view of one embodiment of a portion of the ring seal segment of FIG. 2 according to aspects of the invention.

FIGS. 4A-4C illustrate various embodiments of the peaks 67 and depressions 65 in accordance with the inventive aspects. For instance, FIG. 4A illustrates a semicircular shaped radial inner surface 62 having a radius (r). The peaks 67 are shown with a height (r) and the depressions 65 are also shown with a depth (r). Additionally, the distance between two adjacent peaks 67, or the distance between the relative midline of two adjacent depressions 65, can be 2(r).

As another embodiment of peaks 67 and depressions 65 in accordance with the inventive aspects, FIG. 4B illustrates an elongated semicircular shaped radial inner surface 62 having a radius (r). The elongation of the semicircular shape includes depressions 65 having a depth (r)+(y), where (y) can be any suitable distance for creating vorticity. Likewise, the peaks 67 are shown with a height (r)+(y), where (y) can be any suitable distance for creating vorticity. In this embodiment, the distance between two adjacent peaks 67, or the distance between the relative midline of two adjacent depressions 65, can be 2(r). Although the distance (y) can be uniform throughout the surface 62, variations in (y) are possible such that the surface 62 features peaks 67 and depressions 65 with non-uniform dimensions.

Still yet another embodiment of peaks 67 and depressions 65 in accordance with the inventive aspects is shown in FIG. 4C. In this embodiment, the radial inner surface 62 features a semicircular shape having a radius (r). The depressions 65 can have a depth (r), and likewise, the peaks 67 can have a height (r). Nevertheless, in this embodiment, the distance between the relative midline of two adjacent peaks 67, or the distance between the relative midline of two adjacent depressions 65, can be 2(r)+(x), where (x) can be any suitable distance for creating vorticity. Although the distance (x) can be uniform throughout the surface 62, variations in (x) are possible such that the surface 62 features peaks 67 and depressions 65 with non-uniform dimensions. In this regard, combinations of the embodiments illustrated in FIGS. 4A-4C are also possible.

Figure 3:
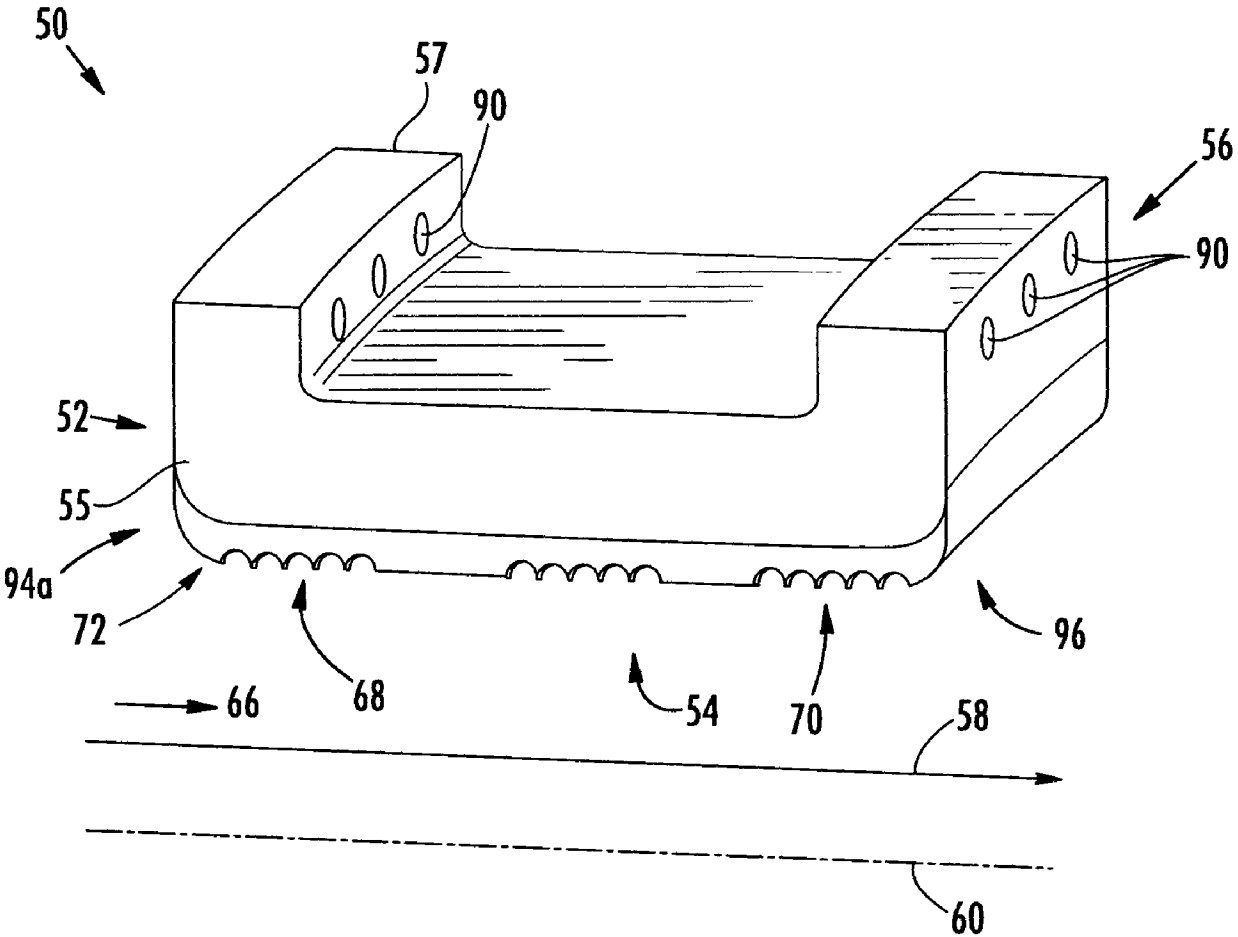
FIG. 3 is an perspective view of another embodiment of a ring seal segment according to aspects of the invention.

FIG. 3 shows another embodiment of a turbine engine ring segment 50 according to aspects of the invention. In this embodiment, the plurality of protrusions 64 are shown as two discontinuous series 68, 70 of peaks 67 and depressions 65. The phrase "discontinuous series" is intended to mean a series of peaks 67 and depressions 65 that include lengths of the inner radial surface 62 having breaks in the peaks 67 and depressions 65, where non-serial peaks 67 and/or depressions 65 are located, or where intermittent stretches of the inner radial surface 62 without peaks 67 and depressions 65 are located. The series 68 can obstruct gas flow in the gas flow direction 58 while the series 70 is particularly advantageously located to obstruct gas flow in the direction opposite to the gas flow direction 58, otherwise referred to as backflow. Although two discontinuous series 68,70 are shown, additional discontinuous series can be provided as desired.

The plurality of protrusions 64 can be formed during the manufacture of the ring segment 50. The inner radial surface 62 of the ring segment 50 can be machined to form the plurality of protrusions 64 therein. In one non-limiting example, depressions 65 can be milled into an inner radial surface 62 to form the peaks 67 and depressions 65 of the plurality of protrusions 64. Other suitable manufacturing process may also be used, such as casting the inner radial surface 62 with peaks 67 and depressions 65 that form the plurality of protrusions 64.

The turbine engine ring segment 50 may also include a coating 72 that forms the inner radial surface 62. The coating 72 may include gas flow protrusions 64 formed in the coating 72. The coating 72 can also be machined to form the gas flow protrusions 64, such as machining the coating with an end mill. The turbine engine ring segment 50 beneath the coating 72 can be made of any suitable material for withstanding the forces imposed on the ring seal segment 50 during engine operation. For instance, turbine engine ring segment 50 can be made of ceramic matrix composite (CMC), a hybrid oxide CMC material, an example of which is disclosed in U.S. Pat. No. 6,744,907, an oxide-oxide CMC, such as AN-720, which is available from COI Ceramics, Inc., San Diego, Calif., or any other suitable material.

The coating 72 can be made of any suitable abradable material, such as friable graded insulation (FGI). Additionally, the plurality of protrusions 64 formed by the abradable coating 72 can aligned, or misaligned, with the path followed by the blade tip 26 to reduce the amount of contact between the inner radial surface 62 and the blade tip 26. For instance, a series of the plurality of protrusions 64 with peaks 67 and depressions 65 can be coupled to an inner peripheral surface of the vane carrier 28 such that the depression 65 between the peaks 67 is in the path followed by the rotating blade tip 26. In this arrangement, the blade tip 26 can rotate with minimal contact with the inner radial surface 62.

In operation, high temperature, high velocity gases generated in the combustor 14 flow through the turbine 16. The gases flow through the rows of vanes 18 and blades 20 in the turbine section 16. The ring seals 34, formed of ring seal segments 50 having an inner radial surface 62 with a plurality of protrusions 64, are used to restrict gases from flowing along the gap gas flow path 66. Should combustion gases flow along the gap gas flow path 66, the plurality of protrusions 64 may induce vortices in the gas as the gas flows over the protrusions 64. The vortices act as additional barriers to obstruct further gas flow along the gap gas flow path 66. The formation of vortices may reduce and/or prevent further gas from traveling along the gap gas flow path 66 and result in greater efficiencies of the turbine engine.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine engine ring seal segment, comprising:

a turbine engine ring segment having an inner radial surface that defines a portion of a gap gas flow path;

wherein the inner radial surface is formed of an abradable ceramic coating and includes a plurality of gas flow protrusions that are oriented transverse to the gap gas flow path;

wherein the gas flow protrusions are formed of a plurality of peaks, each separated by depressions between two adjacent peaks, wherein the depressions have an approximate semicircular shape, a distance between two adjacent peaks is at least equal to a width of the depression, and a height of a single peak is at least six percent of the distance between two adjacent peaks;

wherein vortices are induced in the gas flow in the gap gas flow path; and wherein the plurality of peaks and depressions includes at least two discontinuous series of peaks and depressions and intermittent stretches of the inner radial surface without peaks and depression in between two discontinuous series of peaks and depressions.

2. The turbine engine ring seal segment according to claim 1, wherein the distance between two adjacent peaks is at least the width of the depression and the height of single peak is at least 50% of the width of the depression.

3. The turbine engine ring seal segment according to claim 1, wherein the height of the peaks range between approximately 0.12 mm to 8 mm and the distance between adjacent peaks range between approximately 2 mm and 5 mm.

4. The turbine engine ring seal segment according to claim 1, wherein the coating is friable graded insulation.

5. A turbine engine ring seal segment, comprising:

a turbine engine ring segment having an axial length and an inner radial surface;

wherein at least the inner radial surface is formed of a ceramic matrix composite and includes a plurality of gas flow protrusions that are oriented transverse to the axial length;

wherein the gas flow protrusions are formed of a plurality of peaks, each separated by depressions between two adjacent peaks;

wherein a distance between two adjacent peaks is at least equal to a width of the depression, and a height of a single peak is at least six percent of the distance between two adjacent peaks; and wherein vortices are induced in a gas flow along the radial inner surface; and wherein the plurality of peaks and depressions includes at least two discontinuous series of peaks and depressions and intermittent stretches of the inner radial surface without peaks and depression in between two discontinuous series of peaks and depressions.

6. The turbine engine ring seal segment according to claim 5, wherein the depressions have an approximate semicircular shape.

7. The turbine engine ring seal segment according to claim 6, wherein the distance between two adjacent peaks is at least the width of the depression and the height of single peak is at least 50% of the width of the depression.

8. The turbine engine ring seal segment according to claim 5, wherein the inner radial surface defines a portion of a gap gas flow path and wherein the gas flow protrusions obstruct gas flow along the gap gas flow path.

9. The turbine engine ring seal segment according to claim 5, wherein the height of the peaks range between about 0.12 mm and 8 mm and the distance between adjacent peaks range between about 2 mm and 5 mm.

10. The turbine engine ring seal segment according to claim 5, further comprising a coating on the inner radial surface wherein the coating is an abradable material.

11. The turbine engine ring seal segment according to claim 5, further comprising a coating on the inner radial surface wherein the coating is friable graded insulation.

12. A turbine engine, comprising:

at least one combustor section positioned upstream from a rotor providing a plurality of blades extending radially from the rotor;

a vane carrier providing a plurality of vanes extending radially inward and terminating proximate to the rotor;

a turbine engine ring segment coupled to an inner peripheral surface of the vane carrier and having an axial length and an inner radial surface that defines a portion of a gap gas flow path;

wherein the inner radial surface includes an abradable ceramic coating and includes a plurality of gas flow protrusions that are oriented transverse to the gap gas flow path;

wherein the gas flow protrusions are a series of peaks and depressions between two adjacent peaks, and the depressions have an approximate semicircular shape, a distance between two adjacent peaks is at least equal to a width of the depression and a height of a single peak is at least six percent of the distance between two adjacent peaks, wherein the series of peaks and depressions includes at least two discontinuous series of peaks and depressions and intermittent stretches of the inner radial surface without peaks and depression in between two discontinuous series of peaks and depressions; and wherein vortices are induced in the gas flow in the gap gas flow path.

13. The turbine engine ring seal segment according to claim 12, wherein the distance between two adjacent peaks is at least the width of the depression and the height of single peak is at least 50% of the width of the depression.

14. The turbine engine ring seal segment according to claim 12, wherein the height of the peaks range between about 0.12 mm and 8 mm and the distance between adjacent peaks range between about 2 mm and 5 mm.

15. The turbine engine ring seal segment according to claim 12, wherein the coating is friable graded insulation.

* * * * *